US010499129B2

(12) United States Patent
Borne et al.

(10) Patent No.: US 10,499,129 B2
(45) Date of Patent: Dec. 3, 2019

(54) SOUND REPRODUCTION OR PROCESSING EQUIPMENT WITH INTERCHANGEABLE CLADDING

(71) Applicant: ECRI ELECTRONIC, Guilherand-Granges (FR)

(72) Inventors: Franck Borne, Saint-Peray (FR); Catherine Borne, Saint-Peray (FR)

(73) Assignee: ECRI ELECTRONIC, Guilherand-Granges (FR)

( * ) Notice: Subject to any disclaimer, the term of this patent is extended or adjusted under 35 U.S.C. 154(b) by 0 days.

(21) Appl. No.: 16/306,616

(22) PCT Filed: Jun. 14, 2017

(86) PCT No.: PCT/FR2017/051528
§ 371 (c)(1),
(2) Date: Dec. 3, 2018

(87) PCT Pub. No.: WO2017/216479
PCT Pub. Date: Dec. 21, 2017

(65) Prior Publication Data

US 2019/0141423 A1 May 9, 2019

(30) Foreign Application Priority Data

Jun. 15, 2016 (FR) ..... 16 55537

(51) Int. Cl.
*H04R 1/02* (2006.01)

(52) U.S. Cl.
CPC ..... *H04R 1/025* (2013.01); *H04R 1/023* (2013.01); *H04R 1/02* (2013.01); *H04R 1/026* (2013.01); *H04R 2201/029* (2013.01)

(58) Field of Classification Search
CPC .. H04R 1/025; H04R 1/023; H04R 2201/029; H04R 1/02; H04R 1/026
See application file for complete search history.

(56) References Cited

U.S. PATENT DOCUMENTS 4,298,087 A * 11/1981 Launay ..... H04R 1/345 181/153
2002/0139555 A1* 10/2002 Dodds ..... H02B 1/44 174/50
2004/0208336 A1* 10/2004 Hamada ..... H04R 1/025 381/386

(Continued)

FOREIGN PATENT DOCUMENTS

FR 2 520 573 7/1983
JP 2009-290806 12/2009

OTHER PUBLICATIONS

Anonymous, "iPhone 6 / 6s Silicone Case—white", Sep. 2015, pp. 1-2, XP002766217.

*Primary Examiner* — Andrew L Sniezek
(74) *Attorney, Agent, or Firm* — Clark & Brody

(57) ABSTRACT

The invention relates to an appliance for producing or processing sound, the appliance comprising a cabinet presenting a front face (4), a rear face (5), side faces (6, 7), a top face (8), and a bottom face (9). The appliance includes trim (15) that is removable relative to the cabinet, the trim comprising at least one generally U-shaped facing (16) for covering at least the front face (4) and the side faces (6, 7) of the cabinet, support columns (40) being mounted inside the cabinet (2).

11 Claims, 3 Drawing Sheets

(56) References Cited

U.S. PATENT DOCUMENTS

| | | | | |
|---|---|---|---|---|
| 2009/0227144 | A1* | 9/2009 | Ma | H01R 24/62<br>439/620.15 |
| 2009/0275816 | A1 | 11/2009 | Planman et al. | |
| 2013/0180879 | A1* | 7/2013 | O'Dowd | G06F 1/1628<br>206/521 |

* cited by examiner

SOUND REPRODUCTION OR PROCESSING EQUIPMENT WITH INTERCHANGEABLE CLADDING

The present invention relates to the technical field of appliances for reproducing or processing sound, e.g. such as reader devices such as disk or cassette readers, tuners, sound playback appliances, sound amplifier appliances, sound recording appliances, sound playback appliances, loudspeakers, or loudspeaker enclosures.

These appliances for acoustic reproduction or processing are provided in the form of a generally rectangularly shaped cabinet having various electronic and/or mechanical and/or electrical components installed therein in order to perform the functions given to such appliances.

The appearance of those appliances is determined by their cabinets, which are generally made of a metal material or of wood. Such appliances are frequently difficult to integrate pleasingly in the decorative appearance of a home. This problem of pleasing integration reappears whenever there are alterations in the home.

In the technical field of cell phones, patent application JP 2009 290806 discloses mounting trim on the case of the telephone, which trim comprises a shell of generally U-shape that is held on the case by means of a lid fastened to the case by screws.

The trim described in that patent application can suffer degradation while the cell phone is in use. Furthermore, that solution is not appropriate for putting trim on a sound reproduction or processing appliance that is generally in the form of a cabinet of relatively large size, and that might act as a support for other appliances that are identical or similar.

The solutions presented in patent application US 2009/275816 and in the documentation by Anonymous: "iphone 6/6s Silicone Case—White", September 2015 (September 2015), pages 1-2, XP002766217, present the same drawbacks as the trim described in patent application JP 2009 290806.

The present invention seeks to remedy the drawbacks of the prior art by proposing an appliance for reproducing or processing sound, but that is designed to change its appearance completely, in particular in terms of appearance, throughout the time it is in use, while conserving its integrity.

Another object of the invention is to propose an appliance for reproducing or processing sound having trim that can be changed easily while conserving a certain appearance for the trim.

In order to achieve such objects, the appliance for producing or processing sound, comprises a cabinet presenting a front face, a rear face, side faces, a top face, and a bottom face, the cabinet being provided with trim that can be removed from the cabinet, the trim comprising at least a top plate carrying the top face of the cabinet and a facing that is generally U-shaped in order to cover at least the front face and the side faces of the cabinet. According to the invention, the appliance includes support columns mounted inside the cabinet so that their ends can be accessible from the top face, the top plate being fastened to the ends of the columns by releasable fastener systems.

The appliance of the invention also comprises in combination one and/or more of the following additional characteristics:

- the top plate of the removable trim includes a groove into which the top edge of the facing can be inserted so as to hold the facing in position;

- the removable trim also includes a bottom plate covering the bottom face of the cabinet and fastened to the ends of the columns by a releasable fastener system;
- the bottom plate of the removable trim includes a groove into which the bottom edge of the facing can be inserted so as to hold the facing in position;
- the generally U-shaped facing is made as a single piece or comprises a support plate for supporting a covering fitted thereto;
- the facing presents a front wall that is extended on either side by side walls, the walls extending respectively facing the front face and the side faces of the cabinet;
- the front wall of the facing is connected to the side walls by angled connection walls, and in that the side walls are extended remote from the connection walls by angled finishing walls, the connection walls and the finishing walls extending facing angled connection faces of the cabinet;
- the support columns are provided with feet at their bottom ends;
- the releasable fastener system of the bottom plate includes feet engaged in the bottom ends of the support columns, the bottom plate being mounted between the feet and the bottom face of the cabinet; and
- the releasable fastener system of the top plate includes screws anchored in the top ends of the support columns, the top plate being mounted between the heads of the screws and the top face of the cabinet.

The invention also provides equipment comprising a series of appliances in accordance with the invention superposed on one another. The screws of the releasable fastener system of the top plate of an appliance include studs that are engaged in housings formed in the feet of the releasable fastener system of the bottom plate of an appliance superposed thereon.

Various other characteristics appear from the following description made below with reference to the accompanying drawings, which show embodiments of the invention as nonlimiting examples.

Figure 1:
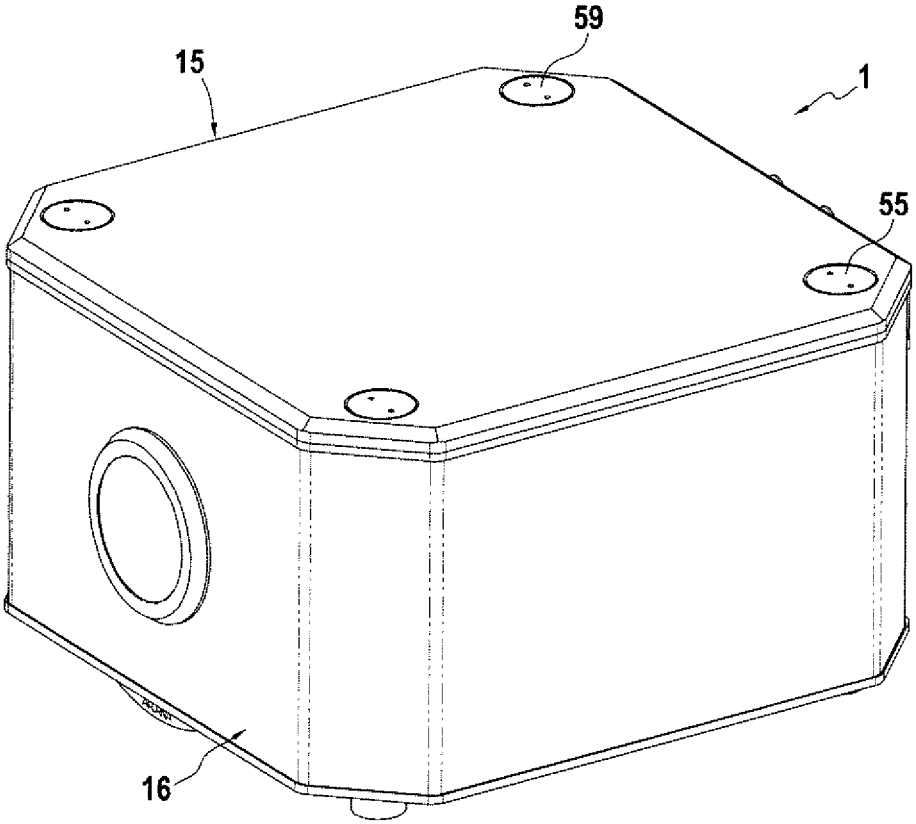
FIG. 1 is a perspective view showing an embodiment of an appliance for reproducing or processing sound in accordance with the invention.

As can be seen in the figures, the invention provides an appliance 1 for reproducing or processing sound in the general sense, such as for example reader appliances such as disk or cassette readers, tuners, sound playback appliances, sound amplifier appliances, sound recording appliances, sound playback appliances, loudspeakers, or loudspeaker enclosures.

This appliance 1 is of generally rectangular shape comprising a cabinet 2 designed to contain various electronic and/or mechanical and/or electrical components 3 for performing the functions given to the appliance. In general manner, the case 2 presents a front face 4, a rear face 5, respective left and right side faces 6 and 7, a top face 8, and a bottom face 9.

The faces of the cabinet 2 are defined by parts extending over said faces in full or in part. The relative dimensions of the faces of the cabinet 2 in the drawings are given purely by way of example, however they could naturally vary as a function of the nature of the appliance 1. Likewise, the general shape of such a cabinet 2 may be different from a rectangular parallelepiped having six optionally-regular faces.

Thus, as shown in the drawings, the cabinet 2 has two "front" angled connection faces 11 and two "rear" angled connection faces 13. More precisely, the front face 4 of the cabinet is connected on either side to the side faces 6 and 7 via the front angled connection faces 11, while the rear face 5 of the cabinet is connected on either side to the side faces 6 and 7 via the rear angled connection faces 13.

In plan view, the cabinet 2 thus presents a profile that is octagonal. In the example shown, the cabinet 2 possesses a perimeter outline of octagonal profile that is irregular or dissymmetrical, since the angled connection faces 11 and 13 are of lengths shorter than the lengths of the front, rear, and side faces. Naturally, the cabinet 2 could present an octagonal profile that is regular or symmetrical, i.e. having eight faces of the same length.

In accordance with the invention, the appliance 1 includes trim 15 that is removable from the cabinet 2. The trim 15 of this appliance thus presents the feature of being easily interchangeable, in particular in order to modify the appearance of the appliance. This removable trim 15 comprises at least one facing 16 that is generally U-shaped for covering at least the front face 4 and the side faces 6 and 7 of the cabinet 2. The facing 16 is of dimensions for completely covering the front face 4 and the side faces 6 and 7 of the cabinet 2.

This facing 16 thus presents a front wall 18 that is extended on either side by side walls 19. In the assembled position, the front wall 18 and the side walls 19 of the facing 16 extend facing respectively the front face 4 and the side faces 6 and 7 of the cabinet 2. The side walls 19 thus extend parallel to each other and substantially perpendicularly to the front wall 18.

In a preferred embodiment characteristic, the facing 16 presents a shape that is congruent or complementary to the shape of at least the front face 4 and the side faces 6 and 7 of the cabinet, so as to cover the faces completely. Thus, in the example shown, the front wall 18 of the facing 16 is connected to the side walls 19 via angled connection walls 21 facing the front angled connection faces 11 of the cabinet.

Advantageously, the side walls 19 of the facing 16 are extended remote from the connection walls 21 by angled finishing walls 22 that extend facing the rear angled connection faces 13 of the cabinet 2. These finishing walls 22 enable the facing 16 to give the appliance 1 a certain appearance effect over practically the entire periphery of the appliance.

It should be observed that the facing 16 presents a U-shape that is preferably continued by the finishing walls 22 that extend towards each other, thereby giving the facing 16 a pincer shape that contributes to assembling it closely with the cabinet. In the assembled position, the facing 16 is thus more or less in contact over its entire area with the front face 4, with the side faces 6 and 7, and with a portion of the rear face 5.

Independently of its general U-shape, the facing 16 may present outlines matching the cabinet 2. In the example shown, the facing 16 includes a circular cutout 25 arranged in the front wall 18 to make it possible to mount on the cabinet a component 26 such as an optical element for embedding in an opening 27 arranged in the front face 4 of the cabinet.

The facing 16 is mounted on the cabinet 2 by sliding the facing 16 vertically onto the cabinet 2. When the cabinet has a component 26 fitted thereon, the component 26 is fastened to the cabinet after the facing 16 has been put into position on the cabinet 2. The facing 16 is thus interposed between the cabinet 2 and the fitted-on component 26.

The facing 16 may be made of various materials that may be selected singly or in combination so as to present sufficient or appropriate stiffness to enable the facing to be mounted on the cabinet 2 while giving the appliance 1 a determined appearance. In an embodiment, the facing 16 is made of a single piece out of a single material, such as for example stone, glass, or metal, with a particular finish (e.g. brushed, polished, or painted).

In another embodiment, the facing 16 includes a support plate having fitted on its outside a determined covering giving the facing its determined appearance. The covering is advantageously fastened or secured to the support plate by any appropriate means. For example, the support plate may be made of a metal material such as aluminum, being covered in a covering made of fabric, leather, wood, gold foil, and/or a printed transfer, for example.

In a preferred variant implementation, the removable trim 15 also includes a top plate 30 covering the top face 8 of the cabinet 2 and fastened to the cabinet 2 by a releasable fastener system 31. In an advantageous embodiment characteristic, the top plate 30 of the removable trim 15 includes a groove 33 into which the top edge of the facing 16 can be inserted so as to hold the facing 16 in position. Naturally, the top plate 30 overhangs the top face 8 of the cabinet 8 so that the groove 33 can receive the top edge of the facing 16 when it is in place around the cabinet 2.

In the embodiment shown in the drawings, the top plate 30 is not a solid plate but occupies only a peripheral belt. In addition to this top plate 30, the removable trim 15 in this embodiment includes a finishing cover **30*a* that covers the top plate 30 completely. Naturally, the top plate 30** may be made of any suitable material, which may be solid or perforated, on its own or in combination with a finishing cover.

In an advantageous embodiment variant, the removable trim 15 also includes a bottom plate 35 covering the bottom face 9 of the cabinet 2 and fastened to the cabinet 2 by a releasable fastener system 36. In an advantageous embodiment characteristic, the bottom plate 35 of the removable trim 15 includes a groove 37 into which the bottom edge of the facing 16 can be inserted so as to hold the facing 16 in position. Naturally, the bottom plate 35 projects out from the bottom face 9 of the cabinet so that the groove 37 can receive the edge of the facing 16 when it is in place around the cabinet 2.

The top and bottom plates 30 and 35 are both made of appropriate materials. For example, the top and bottom plates 30 and 35 may be made of a metal, while the finishing cover **30*a* may be made of glass, enabling the inside of the appliance 1** to be seen.

It should be understood that in this preferred embodiment, the facing 16 is held assembled in position by the top and bottom plates 30 and 35 in which the top and bottom edges of the facing are engaged. For this purpose, the facing 16 is of a height that is slightly greater than the height of the cabinet 2 as defined by the front, rear, and side faces 4, 5, 6, and 7 of the cabinet so as to enable the top and bottom edges of the facing to be engaged in the grooves 33 and 37 in the plates. Furthermore, engaging the facing 16 in the grooves 33 and 37 of the plates contributes to the appearance effect of such trim. The top and bottom plates 30 and 35 also preserve the integrity of the facing 16.

The top plate 30 is assembled to the cabinet by a releasable fastener system 31 made in any suitable manner. In the example shown, it should be observed that the finishing cover 30*a* is also assembled to the cabinet by the releasable fastener system 31. Likewise, the bottom plate 35 is assembled to the cabinet 2 by a releasable fastener system 36 made in any suitable manner.

In a preferred embodiment, the top and bottom plates 30 and 35 are fastened by means of the releasable fastener systems 31 and 36 to the ends of the support columns 40.

Figure 2:
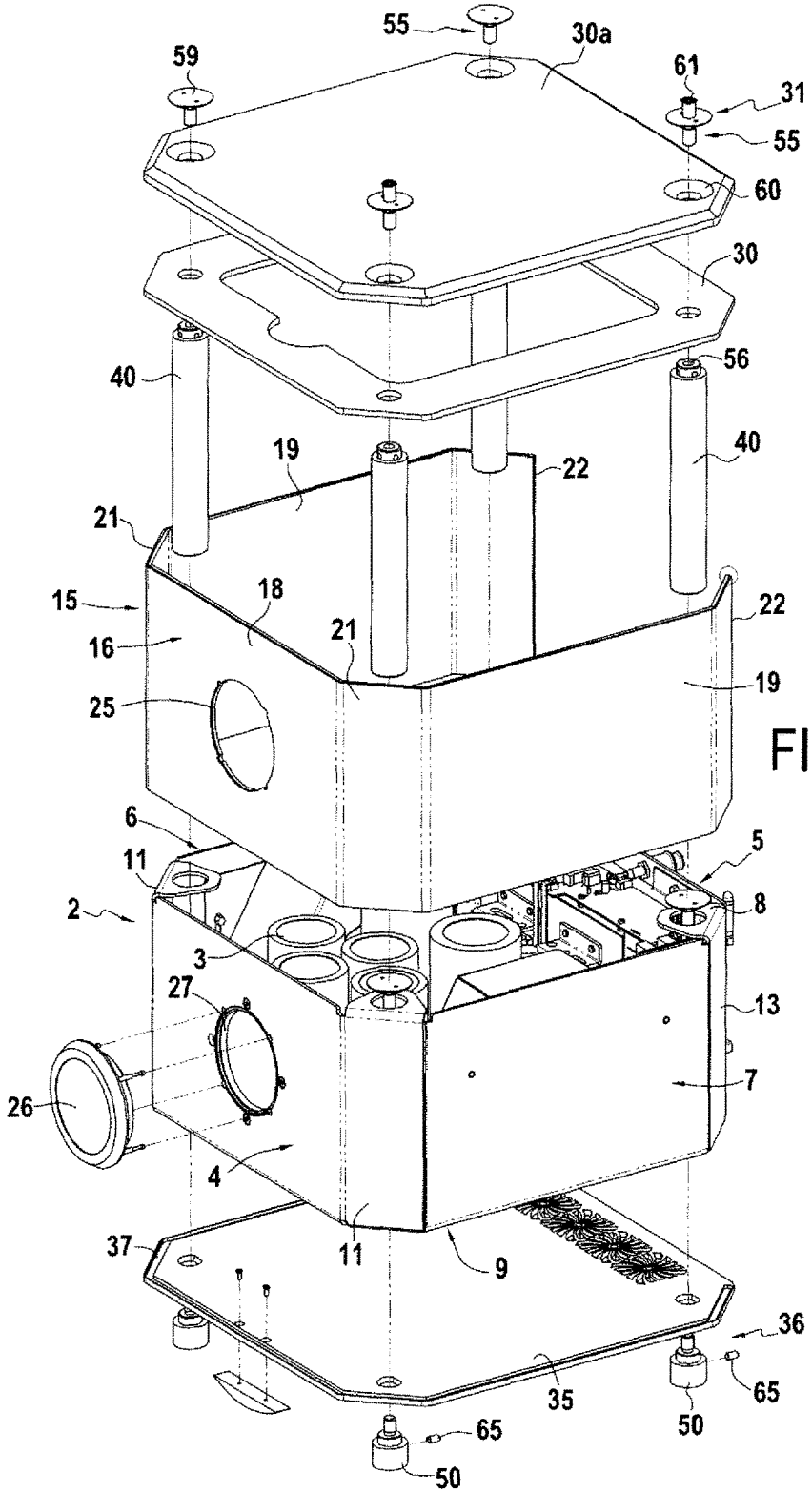
FIG. 2 is an exploded view of an embodiment of an appliance for reproducing or processing sound in accordance with the invention.
Figure 3:
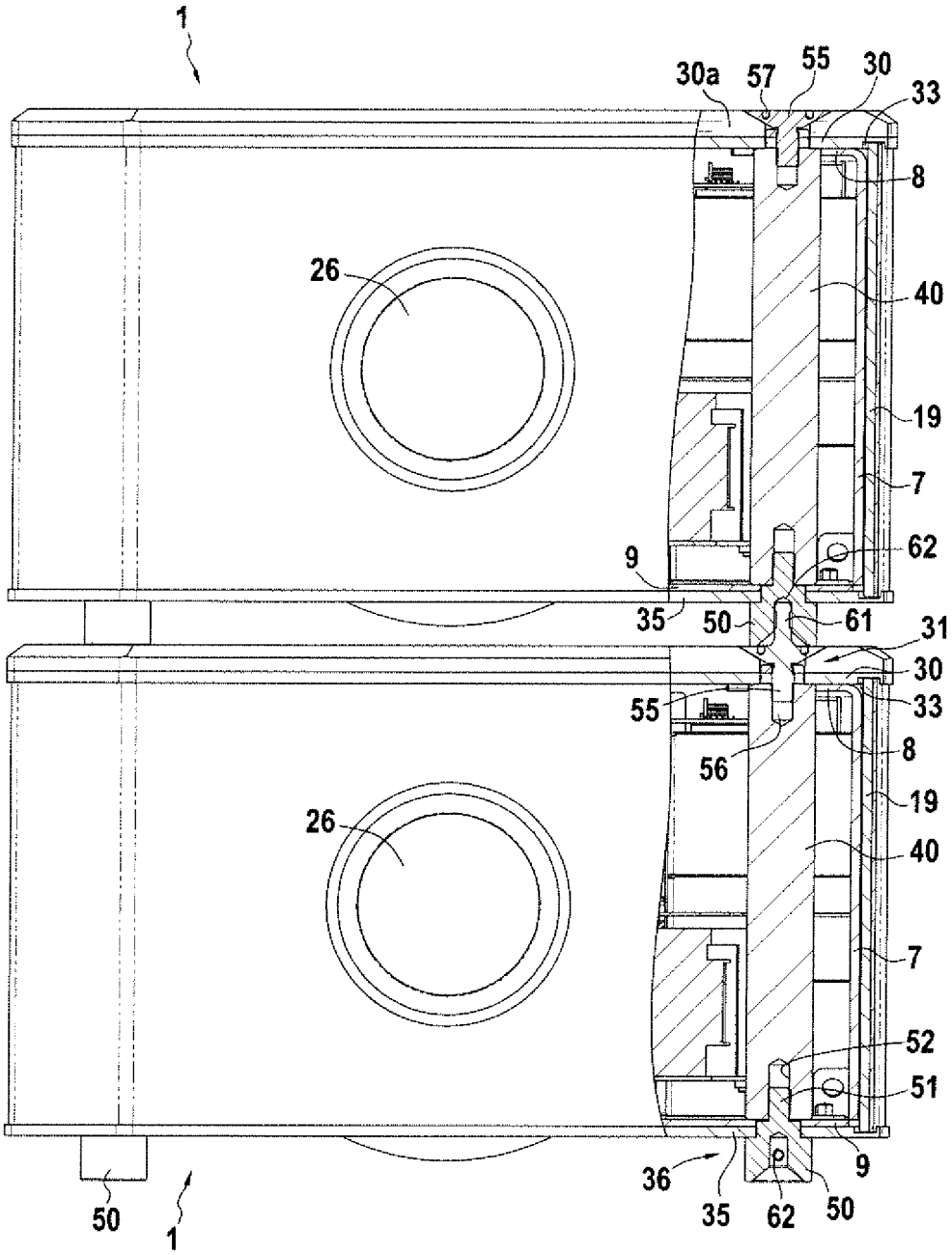
FIG. 3 is a partially cutaway elevation view showing two appliances in accordance with the invention for reproducing or processing sound, in a superposed position.

As can be seen more clearly in FIGS. 2 and 3, the support columns 40 are mounted inside the cabinet 2 so that their ends can be accessible from the top and bottom faces 8 and 9. The support columns 40 pass through the entire height of the cabinet 2 from the bottom face 9 to the top face 8. In the example shown, the cabinet 2 has four support columns 40 arranged substantially in each of the corners of the cabinet 2. Naturally, the number of support columns 40 could be different, e.g. it could be equal to three or to five.

The releasable fastener system 36 for the bottom plate 35 has a foot 50 for each support column 40, which feet 50 are engaged in the bottom ends of the columns 40. The bottom plate 35 is mounted between the feet 50 and the bottom face 9 of the cabinet.

In a preferred variant implementation, each foot 50 is provided with a threaded extension 51 that is screwed into tapping 52 running from the bottom end of each support column 40. The appliance 1 is suitable for standing on its feet 50, of which there are four in the example shown, on a support in such a manner that the top and bottom plates 30 and 35 can extend in horizontal planes.

In the example shown, the releasable fastener system 31 of the top plate 30 includes screws 55 anchored in the top ends of the support columns 40, which are provided for this purpose with respective tapped holes 56 running from the top ends of each of the support columns 40. The top plate 30 is mounted between the heads 57 of the screws and the top face 8 of the cabinet 2. In the example shown, the finishing cover 30*a* receives the heads 57 of the screws.

In a first variant embodiment, the screws 55 of the releasable fastener system for the top plate 30 present flat heads 59 (FIG. 1) that are received in complementary housings 60 formed in the top plate 30, or in the finishing cover 30*a*, as in the example shown. Such screws with flat heads 59 are used when the top plate 30 of the appliance does not receive another appliance superposed thereon.

In another variant embodiment, the screws 55 of the releasable fastener system of the top plate 30 include studs 61 that are engaged in respective housings 62 formed in the feet 50 of the releasable fastener system of the bottom plate of an appliance 1 superposed thereon (FIG. 3). Such a provision makes it possible to build up equipment comprising a series of appliances 1 in accordance with the invention that are superposed on one another. In this superposed position, the load of the appliances 1 is taken up by the support columns 40.

In an advantageous embodiment characteristic, two appliances 1 in accordance with the invention that is superposed one on the other, are locked together by means of one or more lock screws 65 anchored in one or more feet 50 of the appliance 1 that is on top in order to lock one or more studs 61 of the appliance 1 that is underneath.

It can be seen from the above description that the trim 1 for such an appliance 1 is easily changed at will. Provision may be made to change the facing 16 on its own and/or together with the top plate 30 and/or the bottom plate 35 and/or the finishing cover 30*a*.

It is easy to change the facing 16, since it suffices to remove one of the plates, e.g. the top plate 30, possibly together with the finishing cover 30*a*, by releasing the fastener system 31. After removing the component 26, it suffices to lift the facing 16 so as to remove it and replace it with facing presenting a different appearance.

The invention is not limited to the examples described and shown, since various modifications can be made thereto without going beyond its ambit.

The invention claimed is:

1. An appliance for producing or processing sound, the appliance comprising a cabinet presenting a front face (4), a rear face (5), side faces (6, 7), a top face (8), and a bottom face (9), the cabinet being provided with trim (15) that can be removed from the cabinet, the trim comprising at least a top plate (30) carrying the top face (8) of the cabinet and a facing (16) that is generally U-shaped in order to cover at least the front face (4) and the side faces (6, 7) of the cabinet, the appliance being characterized in that it includes support columns (40) mounted inside the cabinet (2) so that their ends can be accessible from the top face (8), the top plate (30) being fastened to the ends of the columns (40) by a releasable fastener system (31).

2. An appliance according to claim 1, characterized in that the top plate (30) of the removable trim (15) includes a groove (33) into which the top edge of the facing (16) can be inserted so as to hold the facing in position.

3. An appliance according to claim 2, characterized in that the releasable fastener system (31) of the top plate (30) includes screws (55) anchored in the top ends of the support columns (40), the top plate (30) being mounted between the heads (37) of the screws and the top face (8) of the cabinet.

4. An appliance according to claim 1, characterized in that the removable trim (15) also includes a bottom plate (35) covering the bottom face (9) of the cabinet (2) and fastened to the ends of the columns by a releasable fastener system (36).

5. An appliance according to claim 4, characterized in that the bottom plate (35) of the removable trim (15) includes a groove (37) into which the bottom edge of the facing (16) can be inserted so as to hold the facing in position.

6. An appliance according to claim 4, characterized in that the releasable fastener system (36) of the bottom plate (35) includes feet (50) engaged in the bottom ends of the support columns (40), the bottom plate (35) being mounted between the feet (50) and the bottom face (9) of the cabinet.

7. An appliance according to claim 1, characterized in that the generally U-shaped facing (16) is made as a single piece or comprises a support plate for supporting a covering fitted thereto.

8. An appliance according to claim 1, characterized in that the facing (16) presents a front wall (18) that is extended on either side by side walls (19), the walls extending respectively facing the front face (4) and the side faces (6, 7) of the cabinet (2).

9. An appliance according to claim 8, characterized in that the front wall (18) of the facing (16) is connected to the side wails (19) by angled connection walls (21), and in that the side walls (19) are extended remote from the connection wails (21) by angled finishing walls (22), the connection wails and the finishing wails (22) extending facing angled connection faces (11, 13) of the cabinet.

10. Equipment comprising a series of appliances (1) according to claim 1 and superposed one on another, the equipment being characterized in that screws of the releasable fastener system (31) for the top plate (30) of one appliance include studs (61) that are engaged in housings (62) arranged in feet (50) of another releasable fastener system for the bottom plate of an appliance superposed thereon.

11. Equipment according to claim 10, characterized in that at least one of the feet (50) is fitted with a lock screw (65) for anchoring the superposed appliance (1) in the at least one of the feet (50).

* * * * *